US006429758B1

(12) United States Patent
Emelo et al.

(10) Patent No.: US 6,429,758 B1
(45) Date of Patent: Aug. 6, 2002

(54) MINIATURE ELECTROMECHANICAL SWITCH

(75) Inventors: Dean Emelo, Rindge; Brian Alexander, Manchester, both of NH (US); Massimo M. Pellegrini, Methuen, MA (US)

(73) Assignee: Renaissance Electronics Corporation, Harvard, MA (US)

( * ) Notice: Subject to any disclaimer, the term of this patent is extended or adjusted under 35 U.S.C. 154(b) by 0 days.

(21) Appl. No.: 10/012,067

(22) Filed: Dec. 4, 2001

Related U.S. Application Data

(60) Provisional application No. 60/251,146, filed on Dec. 4, 2000.

(51) Int. Cl.[7] ..... H01H 51/27
(52) U.S. Cl. ..... 335/4; 335/152; 335/154
(58) Field of Search ..... 335/4, 5, 151, 335/152, 153, 154

(56) References Cited

U.S. PATENT DOCUMENTS

| | | | | |
|---|---|---|---|---|
| 3,562,597 A | * | 2/1971 | White | 335/153 |
| 3,993,970 A | * | 11/1976 | Brownell | 333/262 |
| 4,298,847 A | | 11/1981 | Hoffman | |
| 4,870,385 A | | 9/1989 | Jewell | |
| 5,258,731 A | | 11/1993 | Zemke | |
| 5,699,030 A | | 12/1997 | Leikus et al. | |

* cited by examiner

*Primary Examiner*—Ramon M. Barrera
(74) *Attorney, Agent, or Firm*—Scott J. Asmus; Vernon C. Maine; Maine & Asmus

(57) ABSTRACT

The present invention is an RF electromechanical single pole single throw (SPST) switch providing a low loss path for RF signals in closed position and a high impedance path for RF signals in open position. The structure has two reed switches each having an actuator and two contacts with both reed switches electrically connected in parallel and mechanically attached such that one contact in each reed switch is grounded and the another contact connects to the actuators that are also connected together and to an RF input pin.

10 Claims, 2 Drawing Sheets

MINIATURE ELECTROMECHANICAL SWITCH

CROSS REFERENCE TO RELATED APPLICATIONS

This application claims priority under 35 U.S.C. Section 119 from a U.S. Provisional Patent Application Ser. No. 60/251,146 filed on Dec. 4, 2000, which is incorporated herein by reference for all purposes.

BACKGROUND OF THE INVENTION

1. Technical Field of the Invention

This invention most generally relates to switches for RF signals and applications, and more particularly to RF electromechanical single pole single throw (SPST) switches.

2. Background Art

Mechanical switches are well known in the industry as being reliable and dependable. Such devices were the backbone of the industry for controlling telecommunication signals and RF and microwave signals. The mechanical switches in the past lasted only a few million cycles with few failures and most were not successfully used in extreme environments.

Despite their success, the switches were somewhat expensive, difficult to manufacture and occupied considerable space in many compact electrical designs. As semiconductor technology developed, transistorized switches replaced electromechanical switches in many RF systems. However, if a fail safe mode is required, electromechanical switches are superior, as they are more rugged and can provide optimal switching characteristics. In the higher end of the frequency spectrum mechanical switches are more convenient and flexible for adjustment to matching and broadband performance.

One of the concerns with modem electronic applications is space. Modem devices require compact components, and switches must be able to fit within the allotted space. Another factor for switches is to provide a low loss path when the switch is "ON" and a high loss path when the switch is "OFF". And, when the switch is "OFF" there should be negligible interference, such as an increased inductance in the circuit.

The prior art has attempted to solve the deficiencies noted. The existing standard fast switching elements are reed switches. Reed switches are used in a variety of devices, for example, in the coaxial reverse power protection relay in U.S. Pat. No. 5,258,731 ('731). In the reed relay the reed switch is enclosed within the central channel of the conductive body. Within the channel, the reed switch is concentrically surrounded by a conductive elastomeric tube, and a magnetic coil is wound around a portion of the body. When energized, the coil produces a magnetic field that closes the reed switch. When de-energized, the coil's magnetic field ceases, opening the reed switch. The reed switch, along with the center contacts, form a center conductor within the channel of the relay body. The body and elastomeric tube form an outer conductor. The relay is impedance matched to RF connectors and system transmission line impedances. A nonuniform impedance occurring along the length of the reed switch is balanced by the conforming tube walls. However, this single pole single throw device has no termination of the contacts and the '731 patent relies upon the tube body to perform as a conformal ground.

Another device, U.S. Pat. No. 4,870,385 is a coaxial relay switch having an electrically conductive resin injected into the switch space that rigidly mounts the internal workings. The resin is used to provide some degree of shielding of the signals, and once again, there is no termination.

While being miniature and fast, reed relays cannot be used for switching RF signals because the reed relays do not terminate the system when open, so the reed switch is inadequate in the capacitance portion of the reactance parameter to provide a good match for optimal broadband performance (the return loss has to be within −15 dB). The matching within the device can be done by means of reshaping the tube and the central channel requiring customization and additional complexity, time, and cost.

Accordingly, what is needed is a switch structure that can terminate an RF system when open to provide the return loss within −15 dB in broadband applications, and to be easily matched over the whole frequency range. As a matter of course, the switch needs to be a reliable and dependable device in the RF range up to 3 GHz, incorporating the switching speed and hermetic seal of the reed switch. Such a device also needs to be very compact and, at the same time, rugged and able to take some physical and environmental stress.

SUMMARY OF THE INVENTION

The essence of the present invention is a miniature mechanical switch that addresses the aforementioned problems. In a preferred embodiment the present invention is an RF electromechanical single pole single throw (SPST) switch. More particularly, the present invention is a compact hermetically sealed switch providing a low loss path for RF signals in closed position and a high impedance path for RF signals in open position. As compared to state-of-the art electromechanical devices, the present switch is ten times smaller and forty times faster with a frequency range from DC −3 GHz, switching time 1 ms minimum, repetition frequency 2 KHz minimum, and a life expectancy of not less than 100 million cycles.

The present invention is a structure with adequate capacitance in broadband applications, easily matched, has RF terminations when open, and essentially preserves all the advantages of the reed switch.

The structure according to the present invention includes two reed switches each having an actuator and two contacts. The actuator is normally contacted with one of the contacts. Both reed switches are electrically connected in parallel and mechanically attached to each other in a way where their actuators go to contacts in opposite direction if switching. One identical contact in each reed switch is grounded, and the actuator and another contact are connected to RF path in series. The actuators are connected together and to a connector pin on the RF input end of the switch. One pair of the identical contacts are connected together and to another connector pin on the RF output end of the switch. Another pair of the identical contacts are connected to the shell of the connector on the output end of the switch. Which pair connected to the pin and which one to the shell depends on what kind of switch is needed: normally open or normally closed.

On the input end of the switch the connector's pin is elongated and surrounded by a matching sleeve. In the preferred embodiment of the invention there is a male SMA connector on the input end and a female SMA connector on the output end. The male connector is concentrically attached to the non-ferrous tube having several portions each with different diameter and wall thickness. The reed switches are concentrically disposed in the tube. The female connector is also concentrically attached to the end of the tube oppositely to the male connector. On the outside of the tube a coil is disposed having DC input and output.

Thus, the structure according to the present invention is a very simple mechanically rugged unit. This unit can be matched in easy way, without any changes in shape its machined or formed portions. The two reed switches connected in parallel add to the capacitance portion of the impedance caused the expanded RF performance range of the switch. The matching can be achieved by changing the material of the sleeve and/or its length. The normal state of the switch (whether normally open or close) can be achieved by turning each reed switch at 180 degrees about their longitudinal axes.

It is an object of the present invention to have mechanically sound, simple, reliable and inexpensive switch. And, a further object of the invention is the size—the performance and characteristics achieved by the device are in a package that fits within most electrical applications.

It is a further object of the present invention to have a switch that can be easily changed from normally close to normally open state.

It is another object of the present invention to have a switch that can perform in the RF frequency range from DC to 3 GHz with a switching time better than 1 ms, repetition frequency better than 2 KHz, and life span more than 100M cycles.

An object of the invention is an electromechanical RF switch, comprising a housing having an input end and an output end with a biasing means for actuating the switch. There are a pair of reed relays within the housing, each relay having a switchable actuator with a first contact and a second contact connectable to said switchable actuator, wherein each switchable actuator is electrically connected and wherein each first contact is connected to a grounded shell and each second contact is electrically connected together. An input connecter is connectable to the input end having an input pin electrically connected to the switchable actuator, and an output connector connectable to the output end having an output pin electrically connected to the second contact.

Additionally, an object includes the electromechanical RF switch, further comprising a sleeve having RF absorbing properties surrounding the input pin. And, further comprising a means for matching an RF path, wherein the sleeve is made from a material having a dielectric constant that alters an impedance of the RF path, and the matching means is selecting the material for a particular frequency. Furthermore, a means for matching the RF path, wherein a length of the sleeve alters an impedance of the RF path and the matching means is performed by adjusting the sleeve length for a particular frequency.

Another object is the electromechanical RF switch, wherein each reed relay is hermetically sealed in a glass tube. In addition, wherein the input pin is removable.

An object also includes the electromechanical RF switch, wherein the switch is normally closed with each actuator electrically connected to each second contact. In addition, wherein the switch is changeable from normally closed to normally open by rotating each reed relay 180 degrees so that each first contact is then connected to each actuator and each second contact is then connected to thewgrounded shell.

And an additional object, wherein the biasing means is a coil with a DC input and a DC output. And, wherein the input and output connectors are SMA.

Still other objects and advantages of the present invention will become readily apparent to those skilled in this art from the detailed description, wherein we have shown and described only a preferred embodiment of the invention, simply by way of illustration of the best mode contemplated by us on carrying out our invention. As will be realized, the invention is capable of other and different embodiments, and its several details are capable of modifications in various obvious respects, all without departing from the invention.

BRIEF DESCRIPTION OF THE DRAWINGS

The present invention will be readily understood by the following detailed description in conjunction with the accompanying drawings, wherein like reference numerals designate like structural elements, and in which.

DESCRIPTION OF THE PREFERRED EMBODIMENT

The foregoing description of the preferred embodiment of the invention has been presented for the purpose of illustration and description. It is not intended to be exhaustive or to limit the invention to the precise form disclosed. Many modifications and variations are possible in light of the above teachings. It is intended that the scope of the invention be limited not by this detailed description, but rather by the claims appended hereto.

The switch of the present invention comprises a housing with an RF input end and an RF output end, and having an RF input connector and RF output connector respectively attached.

Figure 1:
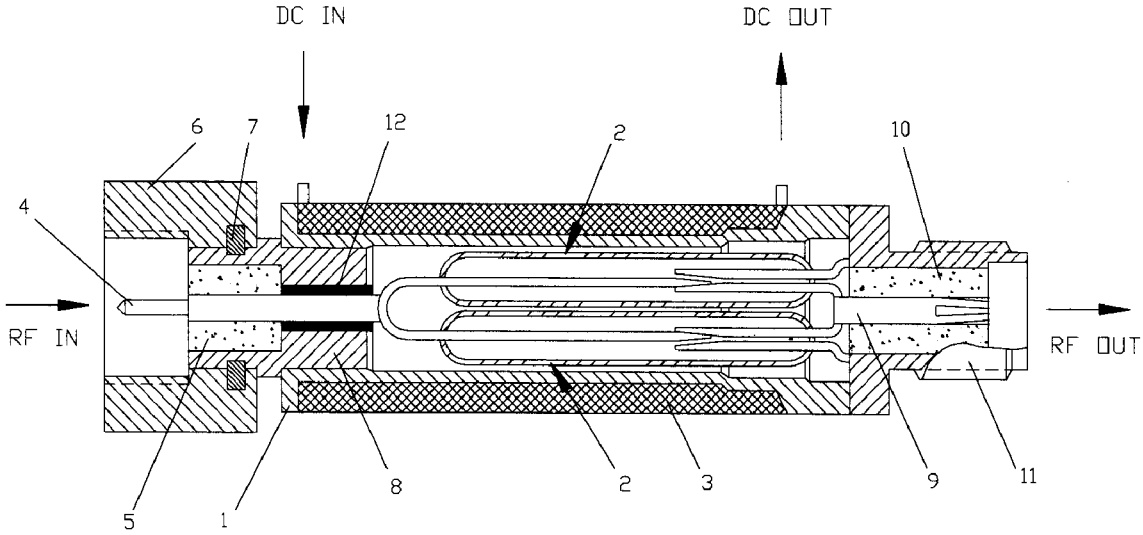
FIG. 1 shows the preferred embodiment of the switch according to the present invention in partial section along its longitudinal axis.

Referring to FIG. 1 the housing comprises a tube 1, two reed switches 2, and a coil 3. The RF input connector comprises an input pin 4, a dielectric 5, a nut 6 with a spring washer 7, and an input shell 8. The RF output connector comprises an output pin 9, a dielectric 10 and an output shell 11. The input pin 4 is removable and has an elongated portion with a sleeve 12 surrounding the input pin 4.

Figure 2:
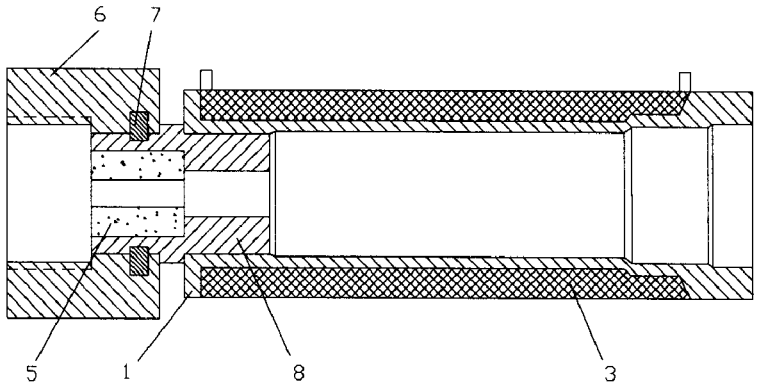
FIG. 2 shows the first assembled portion of the switch to FIG. 1.

The switch structure has a first portion and a second portion. The first portion shown on FIG. 2 includes the tube 1, the coil 3 and the entire RF input connector structure with the exception of the input pin 4. The second portion shown on FIG. 3, includes the two reed switches 2, the input pin 4, the sleeve 12 and the entire structure of the RF output connector, namely the output pin 9, the dielectric 10 and the output shell 11.

Each reed switch 2 includes a glass sealed tube 13, an actuator 14 and two contacts 15 and 16. When the switch is assembled the second portion is inserted into and secured (for example, by means of screws—not shown) to the first portion, as shown on FIG. 1 and represents the device according to the present invention. Other securing means are well known to those in the art including soldering, fasteners, and epoxies/adhesives.

Figure 3:
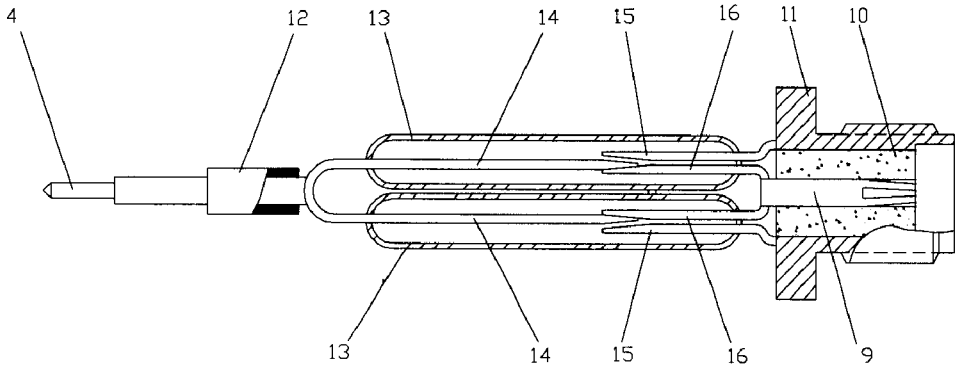
FIG. 3 shows the second assembled portion of the switch to FIG. 1.
Figure 4:
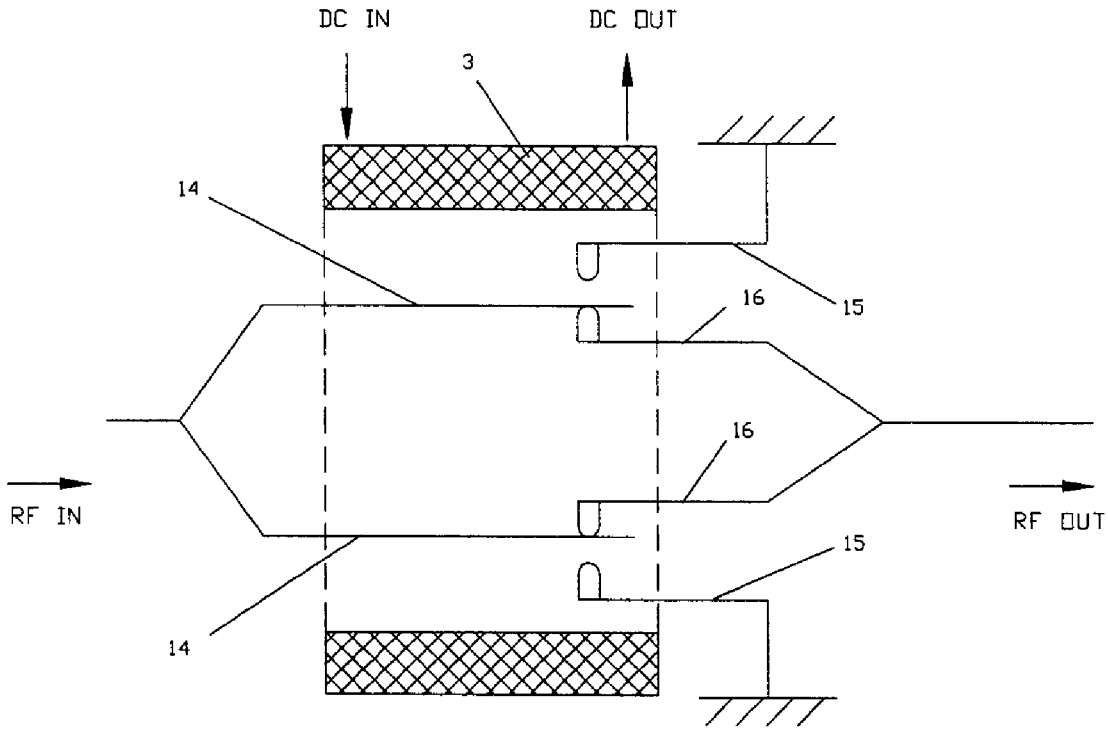
FIG. 4 shows a schematic of normally close switch to FIG. 1.

Referring to FIG. 3 and FIG. 4, actuators 14 are electrically connected together and to the input pin 4 by soldering or other commonly known connecting means. Contacts 16 are connected together and to the output pin 9, and contacts 15 are grounded to the shell 11 if the switch is closed.

Figure 5:
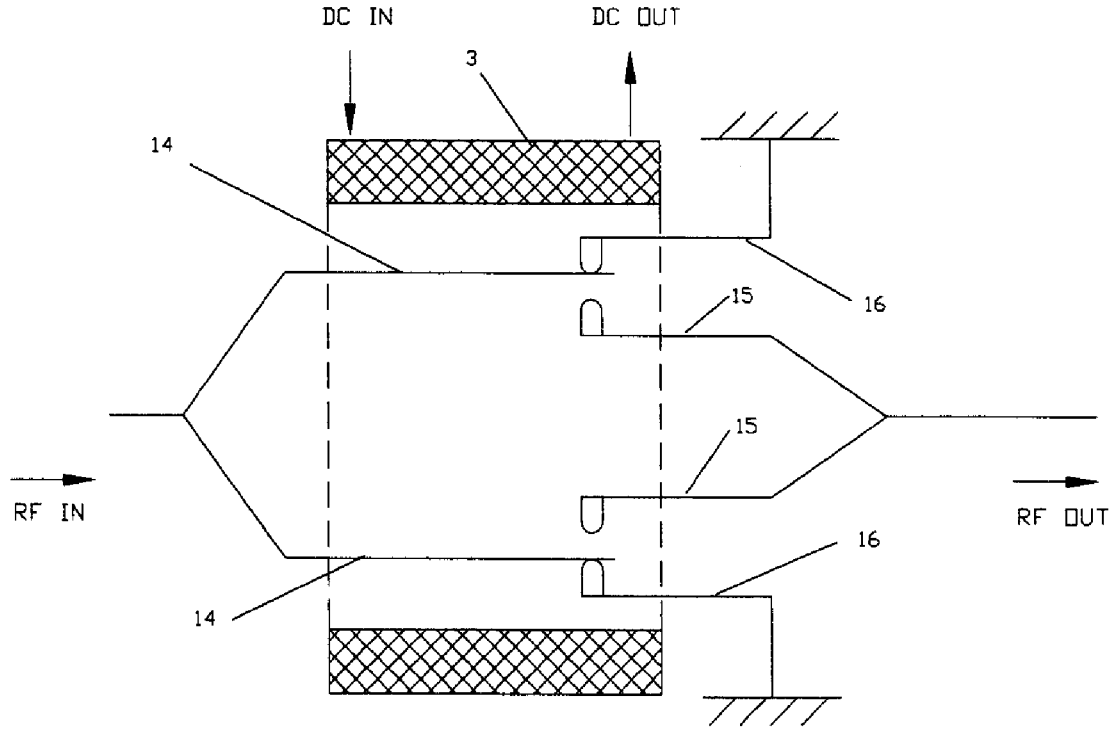
FIG. 5 shows a schematic of normally open switch substantially to FIG. 1, but with reed relays turned at 180 degrees about their longitudinal axes.

In the case of normally open switch, as shown on FIG. 5, wherein the reed relays 2 are rotated 180 degrees about the longitudinal axis, the contacts 15 are connected to the output pin 9, and contacts 16 are grounded. Thus, in order to change the normal state of the switch from closed to open, each reed switch 2 is turned 180 degrees about the longitudinal axis of the glass tube 13 thereby changing the orientation of the contacts 15, 16.

The matching process is realized by means of changing material and/or length of the sleeve 12, which also provides RF absorbing properties. Using materials with different dielectric constant changes the impedance of the RF path as does changing the length of the sleeve 12. For a particular frequency or frequency band, the dielectric constant can be varied for optimal performance. The dielectric adjustment can be done empirically or calculated based upon the specific frequency, as the frequency is inversely proportional to the dielectric constant.

In operation, the switch is connected to a RF system by means of the connectors on the RF input and RF output ends, typical connector types being SMA and Coaxial. The bias power is supplied via the DC IN and DC OUT at the terminals shown in FIG. 1 and FIG. 2. Being energized with a DC signal by the biased circuitry of the system, the coil 3 forces the actuator 14 in each reed switch 2 to simultaneously change its position from that shown on FIG. 1 as connecting to the center conductor 16 to making connection with contacts 15 which is grounded to the shell 11.

The objects and advantages of the invention may be further realized and attained by means of the instrumentalities and combinations particularly pointed out in the appended claims. Accordingly, the drawing and description are to be regarded as illustrative in nature, and not as restrictive.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

What is claimed is:

1. An electromechanical RF switch, comprising:

a housing having an input end and an output end with a biasing means for actuating said switch;

a pair of reed relays within said housing, each said relay having a switchable actuator with a first contact and a second contact connectable to said switchable actuator, wherein each said switchable actuator is electrically connected and wherein each said first contact is connected to a grounded shell and each said second contact is electrically connected together;

an input connecter connectable to said input end having an input pin electrically connected to said switchable actuator;

an output connector connectable to said output end having an output pin electrically connected to each said second contact.

2. The electro-mechanical RF switch according to claim 1, further comprising a sleeve having RF absorbing properties surrounding said input pin.

3. The electro-mechanical RF switch according to claim 2, further comprising a means for matching an RF path, wherein said sleeve is made from a material having a dielectric constant that alters an impedance of said RF path, and said matching means is selecting said material for a particular frequency.

4. The electromechanical RF switch according to claim 2, further comprising a means for matching an RF path, wherein a length of said sleeve alters an impedance of said RF path and said matching means is performed by adjusting said sleeve length for a particular frequency.

5. The electromechanical RF switch according to claim 1, wherein each said reed relay is hermetically sealed in a glass tube.

6. The electromechanical RF switch according to claim 1, wherein said input pin is removable.

7. The electromechanical RF switch according to claim 1, wherein said switch is normally closed with each said actuator electrically connected to each said second contact.

8. The electromechanical RF switch according to claim 1, wherein said switch is changeable from normally closed to normally open by rotating each said relay 180 degrees so that each said first contact is then connected to each said actuator and each said second contact is then connected to said grounded shell.

9. The electromechanical RF switch according to claim 1, wherein said input and output connectors are SMA.

10. The electromechanical RF switch according to claim 1, wherein said biasing means is a coil with a DC input and a DC output.

* * * * *